United States Patent [19]

Perach

[11] Patent Number: 4,992,003

[45] Date of Patent: Feb. 12, 1991

[54] UNIT COMPRISING MESH COMBINED WITH GEOTEXTILE

[75] Inventor: Chaim Perach, Ra'anana, Israel

[73] Assignee: Yehuda Welded Mesh Ltd., Ashdod, Israel

[21] Appl. No.: 296,503

[22] Filed: Jan. 12, 1989

[51] Int. Cl.[5] ..... E02D 17/20

[52] U.S. Cl. ..... 405/258; 405/284; 428/252

[58] Field of Search ..... 405/258, 270, 284, 285, 405/15–20; 428/252, 247, 198

[56] References Cited

U.S. PATENT DOCUMENTS

| | | | |
|---|---|---|---|
| 3,310,453 | 3/1967 | Lappela et al. . | |
| 4,113,907 | 9/1978 | Haage et al. | 428/252 X |
| 4,273,476 | 6/1981 | Kotulla et al. | 405/258 |
| 4,302,496 | 11/1981 | Donovan | 428/252 X |
| 4,324,508 | 4/1982 | Hilfiker et al. | 405/258 X |
| 4,421,439 | 12/1983 | Burg et al. | 405/258 |
| 4,435,466 | 3/1984 | Kuhnel et al. | 428/252 X |
| 4,448,571 | 5/1984 | Eckels | 405/284 |
| 4,472,086 | 9/1984 | Leach | 405/258 |
| 4,503,114 | 3/1985 | Cohen | 428/252 X |
| 4,610,568 | 9/1986 | Koerner | 405/258 X |
| 4,616,959 | 10/1986 | Hilfiker | 405/284 X |
| 4,728,227 | 3/1988 | Wilson et al. . | |
| 4,749,306 | 6/1988 | Demeny et al. | 405/45 |
| 4,813,672 | 3/1989 | Stille | 405/258 X |

FOREIGN PATENT DOCUMENTS

| | | |
|---|---|---|
| 0197000 | 10/1986 | European Pat. Off. . |
| 1906491 | 8/1970 | Fed. Rep. of Germany . |
| 2626650 | 12/1977 | Fed. Rep. of Germany . |
| 2145031 | 2/1973 | France . |
| 1587187 | 4/1981 | United Kingdom . |
| 2073281 | 10/1981 | United Kingdom . |

OTHER PUBLICATIONS

E.Leflaive, "Geotextiles et geomembranes" in Travaux, No. 623, Jul./Aug. 1987, pp. 39–41 (Paris).

*Primary Examiner*—Dennis L. Taylor
*Attorney, Agent, or Firm*—Ladas & Parry

[57] ABSTRACT

A geotextile unit comprising a rigid mesh combined with geotextile material.

10 Claims, 3 Drawing Sheets

UNIT COMPRISING MESH COMBINED WITH GEOTEXTILE

FIELD OF THE INVENTION

This invention is concerned with geotextiles and more particularly with units comprising mesh combined with geotextiles.

BACKGROUND OF THE INVENTION

Geotextiles are materials that are porous and relatively immune to the ravages of geological environment. Accordingly, geotextiles have found use by construction and soil engineers for preventing and/or repairing slips and landslides. Soil systems are inherently particulate systems that are governed by particulate mechanics as distinguished from liquid or solid mechanics. Stresses on soil give rise to an on-linear non-reversible sliding between particles. Soils are granular (sand. gravel, etc.) or cohesive (clays). Cohesive soil particles are plate or rod shaped. Since when under stress, soils tend to slide, it is often necessary to build retaining walls to prevent the sliding or slipping of the soil. Retaining structures are especially necessary when the building or construction is taking place on slopes or elevated areas. In the past retaining walls were constructed by excavating a section of the slope, and a retaining or gravity wall was formed and poured at the front border of the excavated section. After the wall hardened, the remaining opened excavated area was back filled. The back fills used in the past generally were relatively expensive substitute fill, such as sand or gravel, to assure ample drainage and to minimize sliding stresses on retaining walls.

More recently, geotextiles have been used to reinforce the fills by laying sheets of the geotextile in the excavated area to interrupt failure planes. Depending on the specific characteristics of the local soil, this technique enables the reuse of the excavated soil as the fill behind the wall. The geotextile porosity and surface characteristics provide some friction which minimizes "sliding" of the soil and enables drainage to further enhance the stability of the retaining wall.

A problem with this use of geotextiles has been that the geotextiles inherently tend to elongate or stretch notoriously under stress. This stretchable characteristic effectively cancels the capability of the geotextile sheets to retain the soil and thereby to effectively interrupt the failure planes. When the geotextile was fitted to the fill to provide a face, the stretchable characteristic of the geotextile caused the face of the geotextile to bulge.

Another problem encountered with use of the geotextiles as soil reinforcements in the past has been that there is no effective way to attach the geotextile sheets to the concrete retaining walls.

Accordingly, it is an object of the invention to minimize the stretching that occurs in geotextiles in actual use when under stress.

Another object of the invention is to attach the geotextile fill reinforcing material to the retaining wall.

SUMMARY OF THE INVENTION

There is provided in accordance with the present invention, a geotextile unit which comprises a rigid mesh combined with geotextile material.

According to a feature of the present invention, the geotextile material is integral to the rigid mesh.

According to a related feature of this invention, the mesh keeps the geotextile material from stretching without inhibiting the porosity or natural friction of the geotextile material. In fact, a synergistic benefit of the geotextile unit is that the mesh amplifies the natural friction of the geotextile. The amplified friction, the rigidity and the porosity of the geotextile unit effectively enables the conversion of the fill into a unitary block that does not permit internal slides. Accordingly the retaining wall is no longer necessary. A "curtain" structure can be used instead.

Yet another and related feature of this invention is the use of the unique geotextile unit as a soil reinforcement in repairing or preventing slips and landslides, said reinforcement comprising sheets of geotextile units having a rigid mesh integrally covered by geotextile material, said sheets being used as a component of the fill to separate layers of the fill, thereby interrupting failure planes; and said geotextile material in association with the mesh of the unit assuring increased friction with the fill while said rigid mesh prevents the stretching of the geotextile material.

According to yet another feature of this invention, the geotextile unit is made by setting the mesh between two sheets of geotextile material and attaching the mesh to both the sheets of geotextile material.

According to still another feature of the invention, the mesh is attached to both sheets of geotextile material along horizontal and vertical metallic rods making up the mesh.

According to another feature of the invention and in a preferred embodiment thereof, the geotextile material is a plastic material and the sheets are attached to the mesh by a pressurized heat lamination process which heat welds the geotextile sheets together in the areas between the rods.

According to yet another feature of the invention, the geotextile unit and variations thereof are used to enhance the construction of highways, dikes, parking lots and stadiums among other projects which entail soil reinforcement.

BRIEF DESCRIPTION OF THE DRAWINGS

The present invention will be best understood and appreciated more fully from the following detailed description, taken in conjunction with the drawings, where.

DETAILED DESCRIPTION OF PREFERRED EMBODIMENTS

Figure 1:
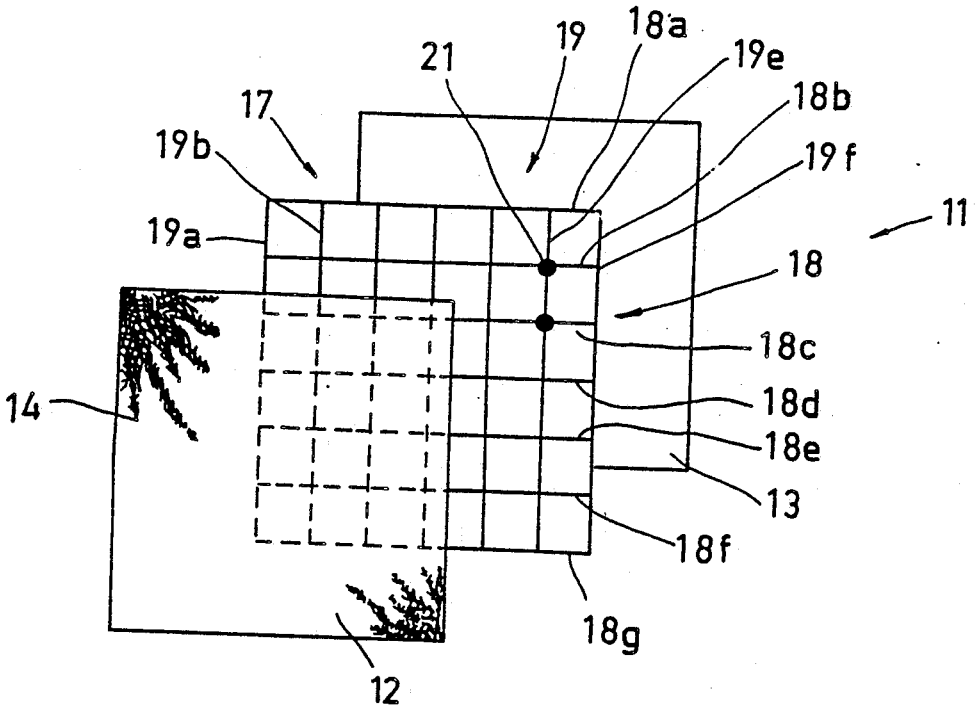
FIG. 1 is an exploded pictorial view of the inventive geotextile unit.

The geotextile unit 11 in a preferred embodiment as shown in FIG. 1 comprises three layers. The first and third layers 12 and 13, i.e., the outer layers shown in FIG. 1, are of geotextile material. In certain embodiments, one of the outer layers may be of a smooth or slippery plastic material, not a geotextile material. As is well known, geotextile material is extremely porous and therefore enables both radial and axial drainage. The good drainage contributes to the stability of the backfill.

Some variations of geotextile material appear to be tufted or fibrous; having what seems like tufts of fibers or curled fibers at the surfaces of the sheets. The fibers provide some friction between the sheets and any surface juxtaposed to the sheets. The fibrous exterior is indicated at 14 on sheet 12 in FIGS. 1 and 2. The fibrous tufted area extends over the outer surface of at least one of the sheets; however, in the interest of clarity of the drawings, it is only shown at the representative area 14. Other variations include material that is comprised of fine plastic netting or mesh.

While the invention is drawn to a geotextile unit, it should be understood that the invention covers units with any material having radial and axial porosity combined with the frictional characteristics of geotextiles, and the ability to resist the natural corrosiveness of soils.

The middle layer 17 is a rigid mesh. In a preferred embodiment, the mesh is comprised of rows 18 and columns 19 of steel rods welded together at the junctions, such as junction 21 of the steel rod of row **18*b* and the steel rod of column 19*e*. The rows are shown as rows 18*a*–18*g*. The columns are shown as columns 19*a*, 19*b* and 19*e***.

Figure 2:
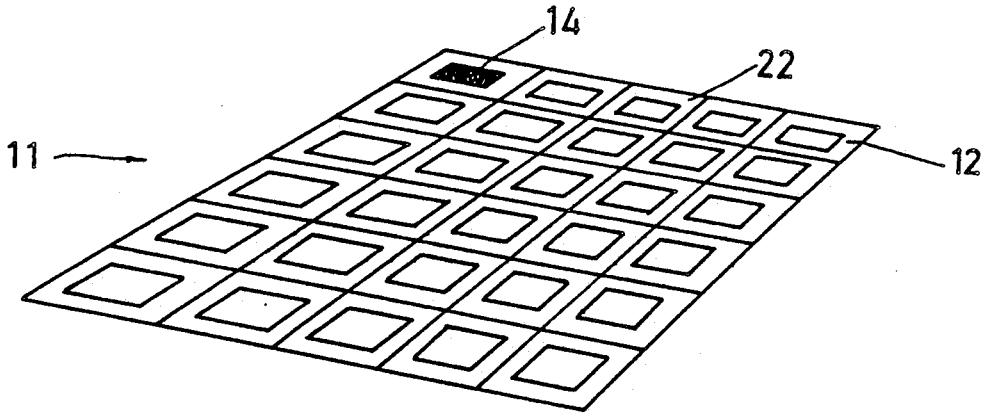
FIG. 2 is a plan view of the assembled geotextile unit.

As shown in FIG. 2, the steel mesh is integrally joined to the sheets 12 and 13 of the geotextile material. According to one method of integrally joining the sheets of geotextile material to the steel mesh, the sheets are joined together along both sides of each of the row and column steel rods. However, according to a preferred embodiment, the sheets are heat laminated together in the areas between the rods such as shown at area 22 in FIG. 2. The units possess the characteristics of high porosity, high resistance to sliding (friction). high tensile strength and are practically non-stretchable.

Figure 3:
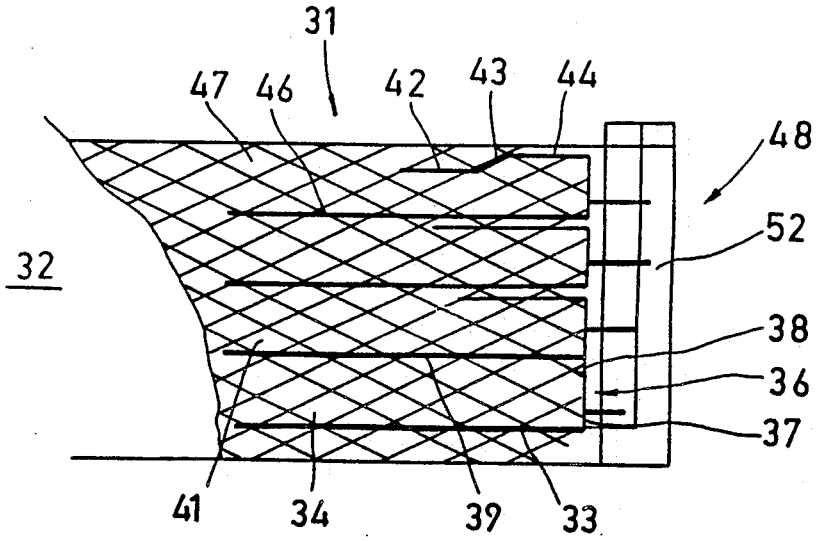
FIGS. 3–5*a* are slide elevational views of different embodiments showing the geotextile unit used for soil reinforcement.
Figure 3A:
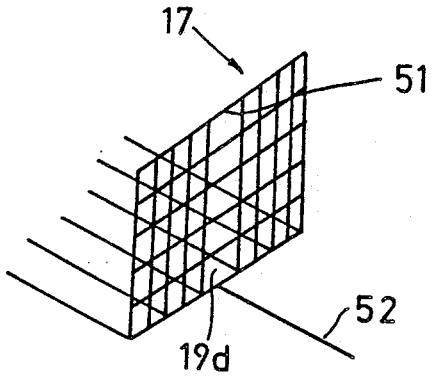

FIG. 3 shows one mode of using the geotextile units for soil reinforcement, behind a "curtain" (thin wall). An excavation 31 is made at the end of the raised soil site 32. A first geotextile unit 33 is laid at the bottom of the excavation. The backfill material, whether clay, sand or gravel which was originally excavated, is placed in a layer 34 on top of the geotextile unit. Note that the mesh enables bending the unit to form different shapes such as the characterized vertical "U" shape 36 at the end of the unit 33. The vertical "U" 36 is defined by the end of the horizontal section of unit 33, the vertical section 37 and the oppositely disposed short horizontal section 38. The fill 34 is compacted in one or more layers and covered by another shaped geotextile unit 39. The unit 39 is again loaded with fill 41. This process is repeated until the excavated section is loaded with fill. Finally the top most geotextile unit 46 has a biased section 43 ending in a horizontal section 44. Fill 42 is loaded on top to complete the filling in of the excavation. The wall is no longer necessary for retaining purposes but is useful to protect the geotextile units.

Figure 4:
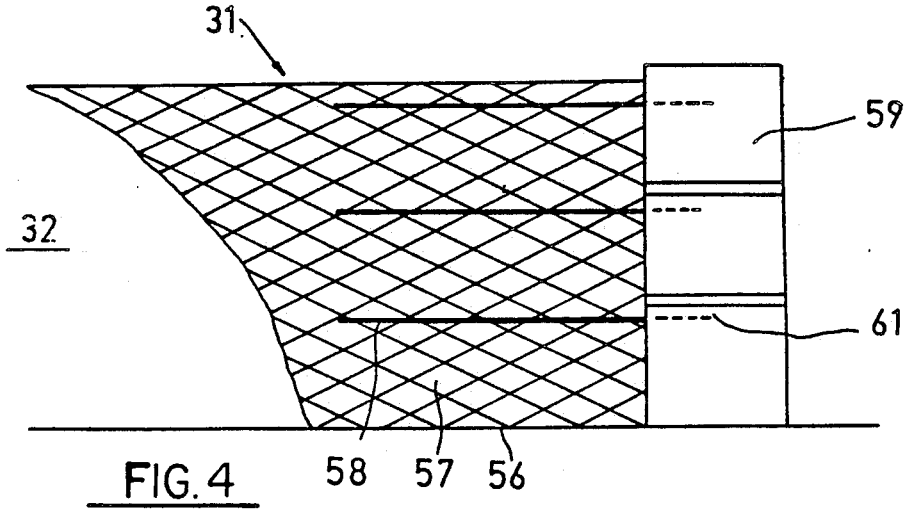

FIG. 4 shows another use of the geotextile units 11 in a soil reinforcing capacity. Here again a section 31 is excavated at one side of upraised section 32. A geotextile unit 56 which is not bent or shaped is placed at the bottom of the excavation. Fill 57 is placed on top of geotextile unit 56 and compacted in one or more layers. The fill preferably is the excavated dirt. A second geotextile unit 58 is placed over the compacted fill. The process is repeated until the desired height is reached. If desired, the portion of the geotextile units abutting the walls have the geotextile material cut away to enable attaching the mesh to the curtain or wall 59 as indicated at 61, for example, where sections of the front portion of the mesh or just protuberances are attached to the wall. If the wall is concrete, the protuberances are inserted into the space into which the concrete is poured.

Figure 5:
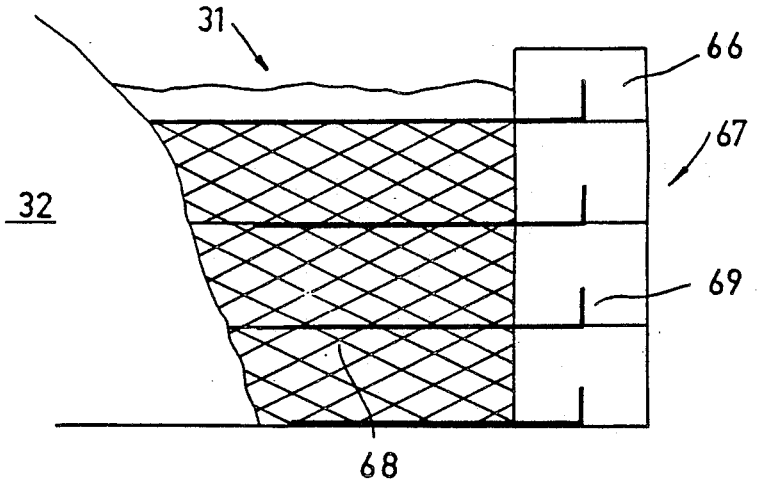
Figure 5A:
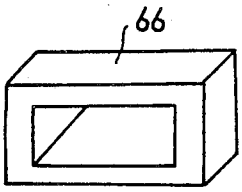

FIG. 5 shows the use of the geotextile unit in conjunction with other building materials; i.e.. hollow blocks such as block 66. The block 66 is shown lying on its side in FIG. **5*a***.

In FIG. 5 proper, the blocks 66 are shown stacked one atop the other to form a wall 67. The wall borders the filled in excavated area 31 juxtaposed to upraised section 32. The geotextile units such as unit 68 are used for soil reinforcement in the manner described with regard to FIGS. 3 and 4, except that protuberances such as protuberance 69 are bent approximately 90 degrees and inserted into the hollow blocks. Subsequently, concrete may be poured into the hollow blocks to finish the retaining wall and attach the wall and the geotextile units. Although the drawing shows a geotextile unit per block, it should be understood that the invention is not so limited.

Figure 6:
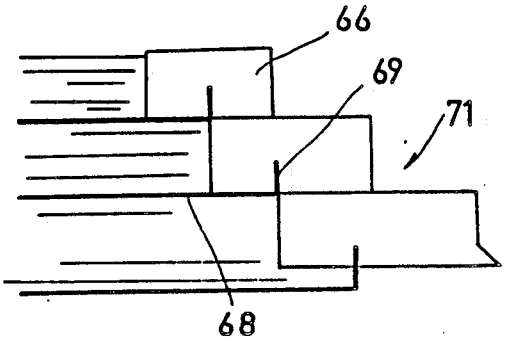
FIG. 6 shows a side sectional view of a part of a stadium constructed using the geotextile unit.

FIG. 6 shows a variation of the construction method of FIG. 5. In FIG. 6 the hollow blocks 66 are staggered to provide an inclined structure 71. The inclined structure is suitable for stadium seating, for example.

Figure 7:
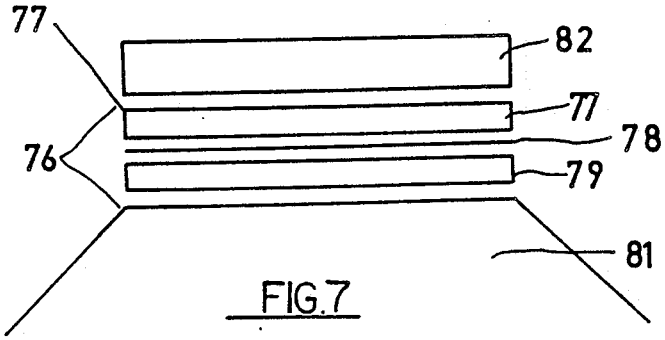
FIG. 7 is an exploded sectional side view of the geotextile unit used in road construction.

FIG. 7 shows the use of a variation of the geotextile unit as a sub-base in road construction. The unit 76 is comprised of a geotextile upper sheet 77, the mesh 78 and a bottom slippery plastic sheet 79. Preferably, the sheets are heat laminated to the mesh to form a unit 76. The unit 76 is a sub-base that is placed on the soil 81. It is especially effective when the soil 81 is expansive. The road is completed in the usual manner well known to those skilled in the art.

The unit 76 "insulates" the asphalt base from the stresses normally caused by the expansion of the soil. When the soil expands, the unit 76 slides on the soil and thus the transmission of the stresses of expansion to the asphalt base is interrupted. The cracks in the roads normally caused by the expansion are minimized, if not eliminated entirely.

In summary, among other benefits, the soil reinforcing of the geotextile unit enables the excavated dirt to be used again as the fill. The friction and rigidity provided by the geotextile unit acting against the juxtaposed ground and fill interrupts the slide planes to strengthen the retention of the upraised section 32. The extent of improved retention enables using significantly less bulky retaining walls. In fact a "curtain" comprised of plastic can be used. Alternatively no wall or a thin concrete wall 48 can be used.

Means on the geotextile unit are provided for attaching the horizontal units to the vertical walls. More particularly, as shown in FIG. **3*a*, the mesh unit is cut at 51 of a column rod such as column rod 19*d* to enable providing a nipple or protuberance 52, which extends into the wall 48. In FIG. 3**, such nipples are shown extending into the wall from all except the top most geotextile unit.

The mesh prevents the geotextile from stretching and thereby assures that the slide planes are properly interrupted. The synergistic benefit of the mesh, among other things, is that the mesh enables forming the geotextile unit to assume vertical spaced apart horizontal and biased positions.

While distinct forms are shown in the Figures, other shapes are certainly within the scope of the invention. The mesh actually amplifies the friction between the geotextile unit and the soil. The mesh also enables attachment to the walls to help support the walls.

In a preferred embodiment, the rods of the mesh are of 7, construction steel, at least 3 mm in diameter. The space between the rows is 5 cm or more and the space between the columns is 5 cm or more. The rods are preferably treated to resist rust or are of a rust resistant alloy.

Among the other benefits of the geotextile units is that the units enable both vertical and horizontal drainage.

The units have been tested to ascertain their effectiveness in causing the fill to act as a unitary block, which is what is ultimately required of a soil reinforcing device. Pull out tests were conducted using meshes alone and compared to pull out tests made using geotextile units. The geotextile unit is almost three times as effective as the mesh alone. For example, it was found that 8 tons per square meter of pull were required to start moving the geotextile unit in a clay soil having an internal friction angle of 29 degrees as compared to three tons to start moving the mesh alone. The spacing of the mesh was 10 centimeters by 20 centimeters and comprised of 4 mm diameter rods. The pulling force was applied to the rods that were spaced apart by 10 centimeters. The vertical load was equivalent to 3.5 meter high compacted backfill. Thus, the unique geotextile units effectively caused the soil to act as a single block.

For background material on soil reinforcing, see the book entitled "Foundations and Earth Structures", Design Manual 7.2 of the Department of the U.S. Navy. Navy Facilities Command; especially applicable are pages 7.2-116,117.

Accordingly, the unit provided herein is a rare and unusual soil reinforcing unit which finds many uses that provide unexpected structural and economical benefits.

While the invention has been described using certain exemplary embodiments, it should be understood that the description is by way of example only and not as limitation on the scope of the invention which is defined by the following claims.

I claim:

1. A porous geotextile unit comprising a porous geotextile material and means for minimizing the stretching of the porous geotextile material including a rigid mesh of construction steel rods and means for integrally coupling the porous geotextile material to the mesh wherein the porous geotextile material comprises first and second sheets of porous geotextile material disposed on opposite sides of said mesh and the means for integrally coupling the porous geotextile material to the mesh comprises heat welds joining said first and second sheets of porous geotexile material only at the areas between the rods.

2. The geotextile unit of claim 1 wherein the construction steel rods are arranged in rows and columns.

3. The geotextile unit of claim 2 and also comprising means for welding the rods together at intersections of the rows and columns.

4. The geotextile unit of claim 2 wherein the geotextile material is removed from selected areas of the unit and wherein the rods form protuberances.

5. Apparatus for soil reinforcement for use in repairing or preventing slips and landslides or the construction of steep slopes, said reinforcement apparatus comprising a plurality of porous geotextile units each comprising a porous geotextile material and means for minimizing the stretching of the porous geotextile material including a rigid mesh of construction steel rods and means for integrally coupling the porous geotextile material to the mesh wherein the porous geotextile material comprises first and second sheets of porous geotextile material disposed on opposite sides of said mesh and the means for integrally coupling the porous geotextile material to the mesh comprises heat welds joining said first and second sheets of porous geotextile material only at the areas between the rods, said units used as components of the fill to separate layers of the fill thereby interrupting failure planes, said units assuring friction with the fill, and said rigid mesh comprising means for preventing the stretching of the material while enabling the forming of the geotextile units.

6. The soil reinforcement apparatus of claim 5 and also comprising wall means and means for attaching the geotextile units to the wall means.

7. The soil reinforcement arrangement of claim 5 and also comprising wall means comprised of stacked hollow blocks, and where protuberances of the mesh of the geotextile units are bent to extend into the hollow blocks.

8. The soil reinforcement arrangement of claim 7 wherein the hollow blocks are precast in one unit.

9. The soil reinforcement arrangement of claim 7 wherein the hollow blocks are staggered to provide stadium like seating arrangements.

10. The geotextile unit of claim 1 and also comprising a sheet disposed on one side of the mesh and formed of a material having less friction than the geotextile material.

* * * * *